United States Patent [19]

Morrison

[11] Patent Number: 4,869,618

[45] Date of Patent: Sep. 26, 1989

[54] DISTRIBUTOR FOR CONCRETE SCREED, AND SCREED ASSEMBLY COMPRISING SAME

[76] Inventor: Donald R. Morrison, 9827 Mt. Holly Rd., Rte. 6, Box 634, Charlotte, N.C. 28208

[21] Appl. No.: 221,114

[22] Filed: Jul. 19, 1988

[51] Int. Cl.[4] ..... E01C 19/30

[52] U.S. Cl. ..... 404/118; 404/114; 404/120

[58] Field of Search ..... 404/96, 101, 102, 113, 404/114, 115, 118, 119, 120; 425/62, 456

[56] References Cited

U.S. PATENT DOCUMENTS

| | | | |
|---|---|---|---|
| 1,474,770 | 11/1923 | Fitzgerald et al. | 404/113 |
| 1,623,142 | 4/1927 | Walsh | 404/124 |
| 3,252,390 | 5/1966 | Martinson | 404/102 |
| 3,463,063 | 4/1968 | Caron et al. | 404/124 |
| 3,703,856 | 11/1972 | Wikel et al. | 404/111 |
| 3,832,079 | 8/1974 | Moorhead | 404/72 |
| 4,213,749 | 7/1980 | Morrison | 404/119 X |
| 4,466,757 | 8/1984 | Allen | 404/114 |

*Primary Examiner*—Bruce M. Kisliuk
*Assistant Examiner*—Matthew Smith
*Attorney, Agent, or Firm*—Steven J. Hultquist

[57] ABSTRACT

A distributor frontally mountable on a screed to minimize or eliminate the manual distribution and leveling of freshly poured concrete which is otherwise required prior to screeding. The distributor comprises a rotatable body bearing an array of circumferentially and axially staggered plate elements. The plate elements may be swept back and are staggered so that only selected ones of the plate elements in the array are in contact with the wet concrete at any point in time of operation, with the direction of travel of the plate elements being toward the screed in the upper quadrants of rotation of the rotatable body, and away from the screed in the lower quadrants of rotation.

20 Claims, 7 Drawing Sheets

DISTRIBUTOR FOR CONCRETE SCREED, AND SCREED ASSEMBLY COMPRISING SAME

BACKGROUND OF THE INVENTION

1. Field of the Invention

This invention relates generally to a distributor mountable frontally of a concrete screed, and to a screed assembly comprising such distributor.

2. Description of the Related Art

Applicant's prior U.S. Pat. No. 4,030,873 discloses a portable screed incorporating a motor-driven vibrating shaft within a light-weight open structural frame. A winching mechanism for a vibrating shaft type screed is described in applicant's prior U.S. Pat. No. 4,253,778.

Another type of screed employs a roller which is rotated in a direction opposite to the direction of travel and screeds concrete by moving the roller over freshly poured concrete in front of the roller. One such motor-driven screed roller is the Razor Back Roller Finisher sold by Allen Engineering Corporation of Paragould, Arkansas. A similar type of roller screed identified as the Hurricane screed is sold by C & S Manufacturing Company of Tulsa, Oklahoma.

The roller type screed has a number of advantages particularly in application to screeding concrete on slopes and grades, but has the disadvantage of not consolidating concrete as effectively as does a vibrating frame type screed.

In addition, when roller screeds are provided in extended lengths, above about 25 feet, deflection of the roller element is encountered, which adversely affects the profile of the concrete being screeded in many applications, or alternatively requires the fabrication of the roller element with a thick-walled structure to resist the deflection.

In an attempt to overcome the deficiencies of the roller type screeds while realizing the benefits associated with the vibrating frame type screeds, applicants' copending U.S. application Ser. No. 936,480 filed Nov. 26, 1986, entitled "Multi-Section Screed Roller Apparatus (now abandoned)," proposes an improved screed comprising an open multi-section frame on the front of which is mounted a motor-driven multi-section screed roller, and behind which is provided a pair of screed plates. On the rear of this screed is provided a driven vibrating shaft which extends lengthwise of the screed to induce vibration primarily in the trailing portions of the screed for consolidation of the concrete after it has been roughly screeded and graded by the multi-section roller. This apparatus further includes means for winching the screed in the direction of travel, and incorporates a turn buckle arrangement compensating for any tendency of the multi-section roller to deflect when the screed length is relatively long.

While the screed roller apparatus of the aforementioned application Ser. No. 936,480 incorporates a number of advantageous features of roller screeds and vibrating frame type screeds, in applications where very wet concrete is being screeded, the rough screeding, grading and distributing functions of the roller are not fully optimally achieved.

Another screed apparatus which has been commercially introduced is the Curl Edge Form concrete screed of AWS Manufacturing Inc. (Yorkville, Illinois). This screed features a frontal curl edge form wherein, the frontal screed blade is enclosed by a box-type assembly having a generally concavely formed frontal surface extending upwardly and forwardly from the box. This structure is said to provide increased concrete grading speed, whereby the concrete does not have to be graded as closely as would be the case in the absence of the curl edge form. The curl edge is said to curl the concrete forward during screeding to accomplish a more uniform finish, eliminating rollover of concrete, and improving forward speed.

U.S. patent application Ser. No. 006,508 filed Jan. 22, 1987 in the name of Donald R. Morrison (U.S. Pat. No. 4,722,638), discloses a concrete screed comprising an elongate frame with screed plates connected to its leading and trailing portions, and with a plow body mounted on the frame in close proximity to the leading screed plate. The plow body presents discrete surface portions including (i) a first generally horizontal surface portion extending forwardly from the vicinity of the first screed plate to a front leading edge and generally horizontally aligned with the first screed plate, and (ii) a second surface portion integrally joined to the front leading edge of the first surface portion and extending upwardly therefrom to an upper edge. Such plow body is highly beneficial in facilitating a high-speed, high-efficiency screeding operation, in which the applied concrete is directed by the plow body to the leading and trailing screed plates in succession, to achieve rapid application of a screeded surface to the concrete, and a high level of consolidation of the concrete in the screeding operation.

Although the various screeds described above are useful to varying degrees in achieving improvements in the screeding process, a particular problem in commercial screeding operations is the time and manpower typically required for redistributing the poured concrete before it is screeded. After the concrete is poured, workers with shovels or other implements are conventionally employed to redistribute the poured concrete, so that the wet concrete surface subsequently contacted by the screed is sufficiently level. If such manual leveling is not carried out, the concrete after screeding frequently exhibits "holes" where sufficient concrete was not provided, and/or "pile-up" of wet concrete occurs in which the piled concrete will either resist movement of the screed in its intended direction, or else "spill over" the top of the screed blade and thereby avoid the screeding process.

In an effort to reduce or eliminate the time, effort, and expense of manually leveling the poured concrete before screeding, screed designs have been proposed in which frontal distributors are provided on the screed to enhance the distribution and leveling of the concrete prior to contact with the active screeding surfaces.

One such device is the Allen Auger Paver TM manufactured by Allen Engineering Corporation, Paragould, Arkansas in which a spreading auger is mounted on the screed frame and reciprocated longitudinally thereof. The auger spreads the concrete and moves it forward, to minimize hand work, with the auger assembly automatically cycling at selected travel speeds. See also U.S. Pat. No. 4,466,757, assigned to the same company, which discloses a vibratory concrete screed with a concrete spreading device coupled to the screed frame to level the surface of the plastic concrete and distribute same in front of the screed blade. The spreading device includes a grading device having either an auger or a grading blade or both. The side-to-side translation of the grading device along with screed frame laterally distributes the excess concrete and displaces the concrete forward and away from the screed blade. The aforementioned auger-type screed systems, although representing an improvement in terms of eliminating manual labor in the distributing and leveling operation, is inherently limited to relatively low forward travel speeds, due to the necessity of accommodating the side-to-side movement of the bridge carrying the auger and/or grader means.

Accordingly, it is an object of the present invention to provide a distributor apparatus attachable to a screed, which provides a highly efficient distribution and leveling of freshly poured concrete for subsequent screeding, and which concurrently accommodates high speed forward travel of the screed across the concrete which is distributed and leveled by the distributor means.

It is another object of the present invention to provide a screed comprising such distributor, which is capable of high-speed screeding operation, while reducing or eliminating manual labor otherwise required to distribute and level the concrete prior to screeding thereof.

Other objects and advantages of the present invention will be more fully apparent from the ensuing disclosure and appended claims.

SUMMARY OF THE INVENTION

In one aspect, the present invention relates broadly to a distributor for frontal attachment to a screed, the distributor comprising an axially extending rotatable body, an array of circumferentially and axially staggered blade elements joined to the rotatable body, and means for attaching the distributor frontally of a screed.

Another aspect of the invention relates to a screed assembly comprising a screed, and a distributor of the abovedescribed type frontally attached thereto.

Another aspect of the present invention relates to a method of forming a concrete surface using a screed assembly of the above-described type.

Other aspects and features of the invention will be more fully apparent from the ensuing disclosure and appended claims.

DETAILED DESCRIPTION OF THE INVENTION, AND PREFERRED EMBODIMENTS THEREOF

Figure 1:
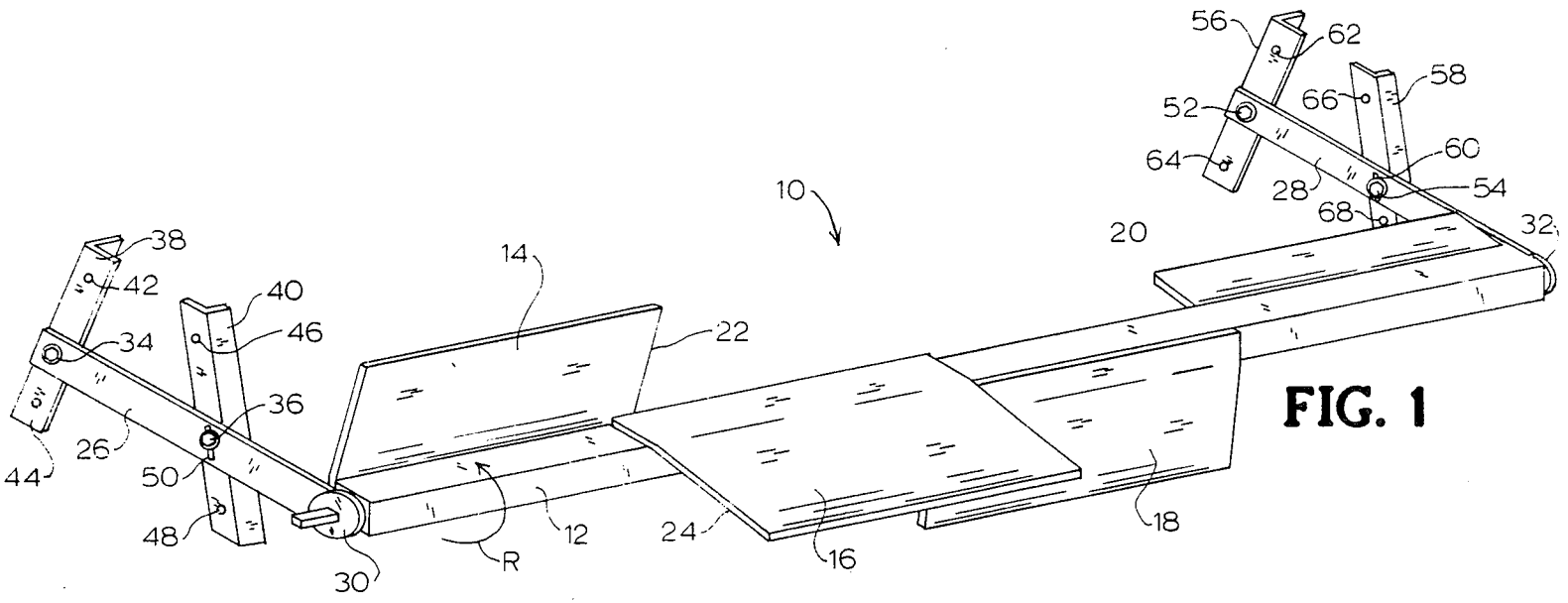
FIG. 1 is a perspective view of a distributor according to one embodiment of the present invention.

Referring now to the drawings, FIGS. 1–7 show various perspective, plan, and elevation views of a distributor according to one embodiment of the invention, in which the same apparatus elements are identically numbered in all views.

This distributor is of a type which is detachably mountable on a screed. The screed, while preferably of rectangular or triangular cross-section, may have any suitable cross-sectional shape. It will therefore be appreciated that the distributor apparatus of the present invention may be fabricated with any suitable mounting means, to accommodate any configuration of screed with which the distributor is advantageously utilizable.

As shown in FIGS. 1–7, the distributor 10 comprises a main axially extending rotatable body 12 with a square cross-section, having sides which may for example be approximately 3 inches in length, whereby the cross-section has a dimension of 3 inches × 3 inches. The axial dimension of the rotatable body 12 may for example be about 10 feet, it being recognized that the dimensions of the distributor may be varied widely depending on the type of screed to which it is adapted to be employed, and the specific end use application.

Figure 2:
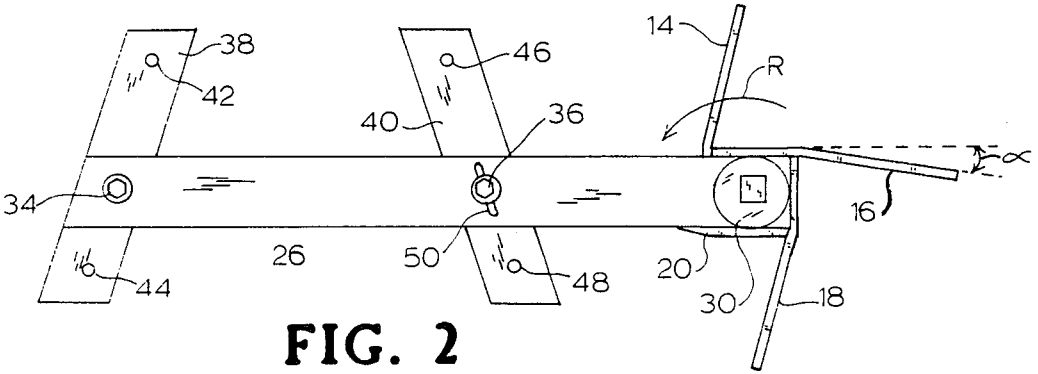
FIG. 2 is an end elevation view of the distributor of FIG. 1.
Figure 7:
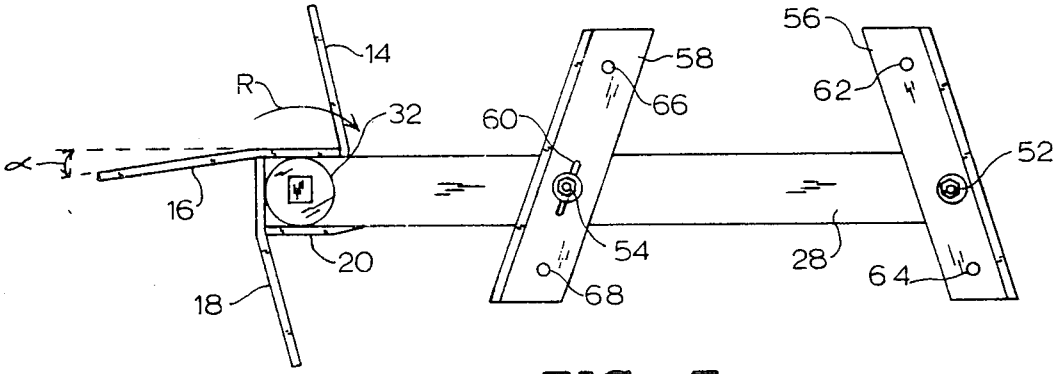
FIG. 7 is an end elevation view of the distributor of FIG. 1, showing the end opposite that shown in the FIG. 2 view.

Joined to the rotatable body 12 is a series of circumferentially and axially staggered plate elements 14, 16, 18, and 20, which as shown in the end elevation views of FIGS. 2 and 7 are joined in face-to-face abutting contact with the rotatable body 12 along inner segments of the respective plate elements. The plate elements may be attached to the rotatable body 12 in any suitable manner, such as by welding, use of mechanical fasteners, and the like. It also is within the broad purview of the present invention to integrally form the rotatable body and plate elements as a single structural entity, such as by casting, machining, etc., however in preferred practice, it is suitable to weld the plates to the rotatable body, or to secure same with bolt and nut fasteners. The use of mechanical fasteners is particularly advantageous, insofar as it permits individual plates to be removed from the rotatable body independent of the other plates, should such plates become bent or otherwise damaged during storage, handling, or use.

The plate elements thus are attached in this illustrative embodiment so that they extend outwardly in a generally tangentially manner from the rotatable body, as shown. The plates, as illustrated, may be "swept back" in profile, as best shown in FIGS. 2 and 7, with the plate in side profile comprising two linear segments, the outer one of which is inclined at an angle to the inner segment, defining an included angle between the planes of the respective first and second segments shown as $\alpha$ in FIG. 2. The angle $\alpha$ may be fixed at any suitable value which is advantageous in the particular screeding application contemplated, however it generally is preferred to utilize an angle $\alpha$ of from about 10° to 30°, most preferably from about 15° to about 25°. For example, an angle of substantially about 17° has been utilized to achieve distribution and leveling of wet concrete in a highly effective manner.

It will be recognized that although the plate elements are attached to the rotatable body in generally tangential fashion, presenting a "pin-wheel" configuration of plate elements in side elevation view (see FIGS. 2 and 7), it is within the scope of the present invention to utilize a generally substantially radial configuration of such plate elements, depending on the specific structure of the rotatable body 12.

The plate elements preferably are secured to the rotatable body in circumferentially staggered fashion with axially successive plate elements in the plate array being circumferentially displaced from each other by the same arcuate or circumferential spacing. For example, in the illustrative distributor shown in FIGS. 1–7, the consecutive plate elements 14, 16, 18, and 20 are spaced apart at 90° intervals.

Such regularity in circumferential staggering is desirable for the reason that it permits uniformity to be achieved in the plate element surface area which is in contact with the wet concrete at any given point in time during operation of the distributor. For example, the distributor in FIGS. 1–7 during operation has only one plate element in contact with the poured concrete at any given time. It is apparent that the power requirements for rotation of the distributor body are thereby minimized, relative to an axially continuous surface contacting the wet concrete.

Figure 3:
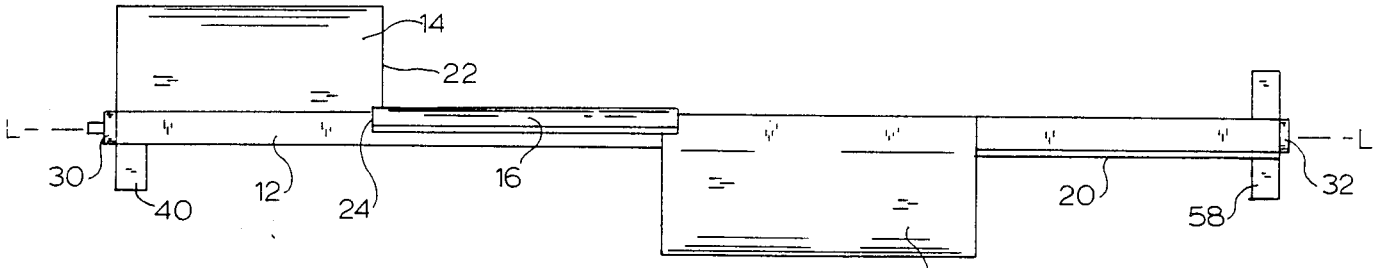
FIG. 3 is a front elevation view of the distributor of FIG. 1.
Figure 4:
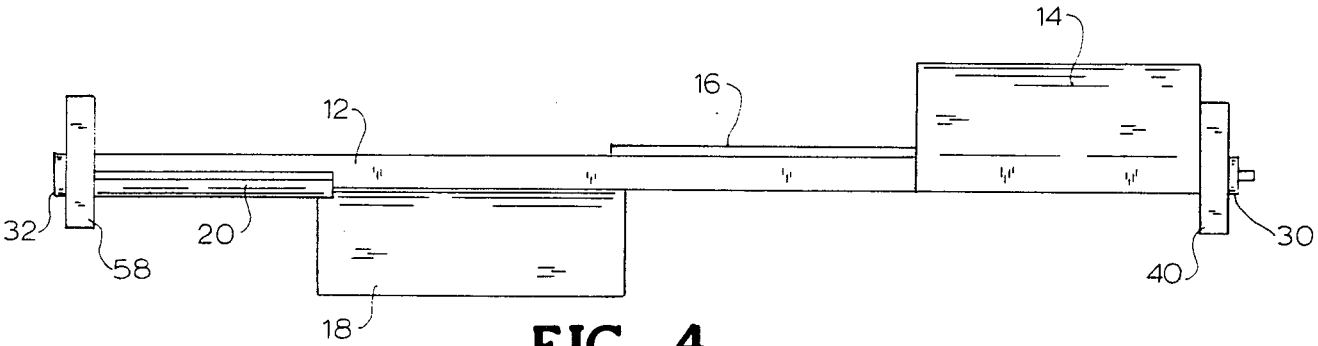
FIG. 4 is a rear elevation view of the distributor of FIG. 1.
Figure 5:
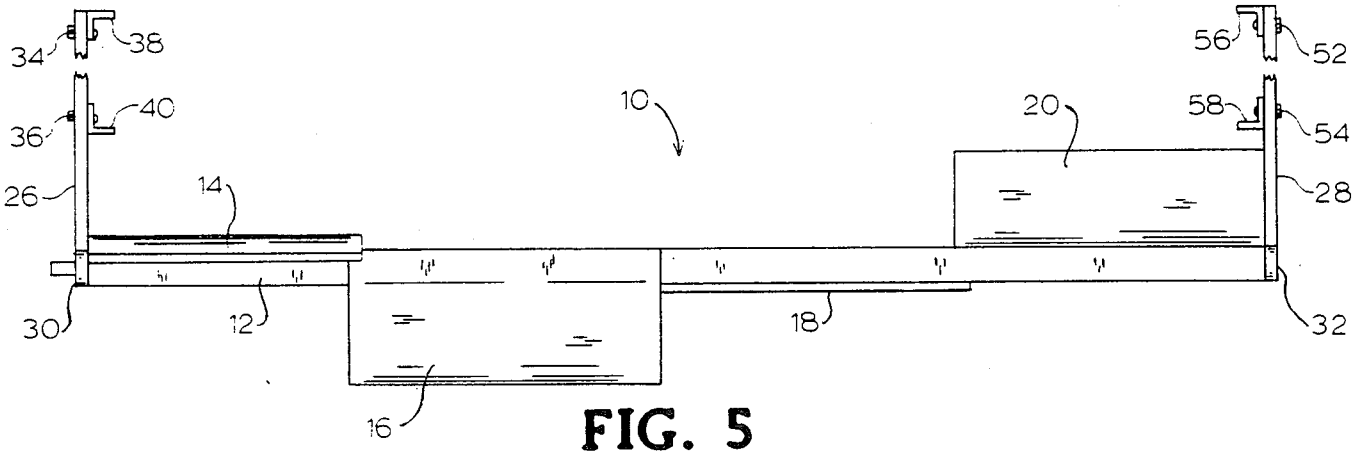
FIG. 5 is a top plan view of the distributor of FIG. 1.
Figure 6:
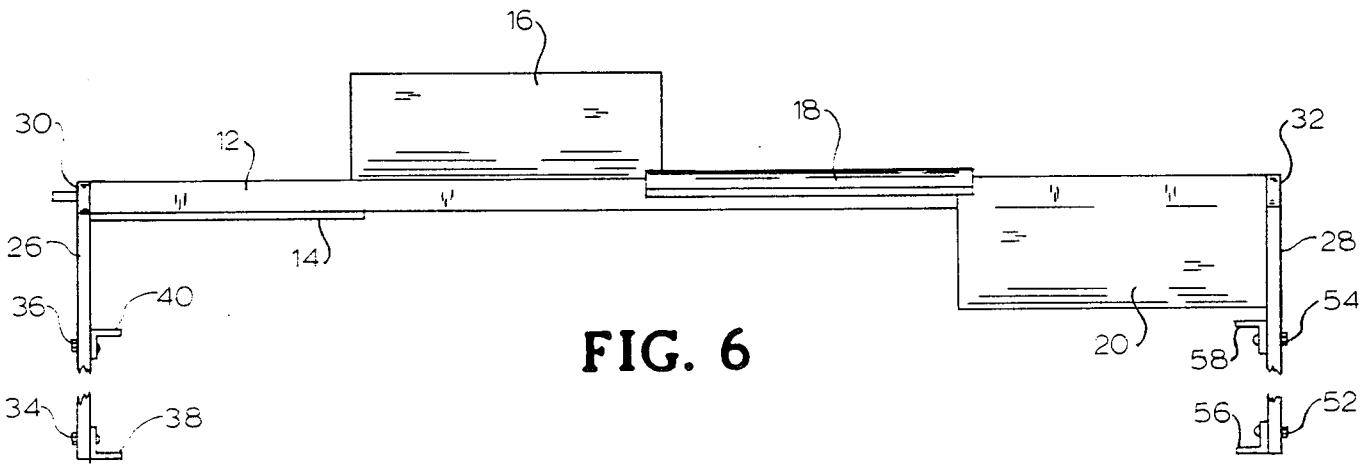
FIG. 6 is a bottom plan view of the distributor of FIG. 1.

As used herein, the term "axially" refers to a direction parallel or coincident with the axis of rotation of the elongate rotatable body (axis L—L in FIG. 3). The term "circumferentially" refers to the circumference of the rotatable body when viewed in end elevation view as in FIGS. 2 and 7.

The rotatable body 12 may be of any suitable configuration, such as a tubular or cylindrical shape, or the square cross-sectioned shape shown in FIGS. 1–7, or any other shape accommodating the plate elements, such as an open frame structure, to which the plate elements may be suitably attached, and which is rotatable about a longitudinal axis. Further, although the plate elements in the illustrative embodiment of FIGS. 1–7 are swept back in configuration, it is also within the scope of the invention to utilize flat tangentially extending plate elements, as well as plate elements having a curvilinear profile in side view (the side view of the plate element corresponding to the end elevational view of the distributor, such as is shown in FIGS. 2 and 7, which shows the side edges of the mounted plate elements).

The plate elements 14, 16, 18, and 20 are axially staggered along the rotatable body 12, with adjacent elements axially overlapping. For example, in a distributor comprising a rotatable body having the dimensions previously described herein (viz., 10 foot length, 3"×3" cross-section), the plate elements may have a length (i.e., a dimension in the axial direction) of 32 inches, with the width (i.e., the dimension perpendicular to the rotatable body axis, along the plate side edge) of from about 12 to 14 inches, with approximately 1 inch axial overlap between adjacent plates in the array.

The purpose of axial overlap of successive plate elements in the array along the axial direction is to insure that the poured concrete is fully contacted by the plate elements in sequence. If an axial gap existed between adjacent plate elements, then the concrete would not be distributed and leveled between the adjacent plate elements, with the resulting potential for holes in the concrete and/or concrete spillover during the screeding operation.

It will be appreciated that the adjacent plate element side edges, for example side edge 22 of plate element 14 and side edge 24 of plate element 16, could be substantially co-planar with one another, in that these respective side edges would lie in a common plane perpendicular to the axis of the rotatable body 12. Nonetheless, it is preferable in practice, for reasons of obtaining optimal efficiency in the distributing and leveling operations carried out by the distributor, to position the plate elements in the axially overlapping configuration, as shown.

The distributor 10 comprises means for mounting on a screed, such as the horizontal frame members 26 and 28, on which the rotatable body 12 in turn is mounted, in a manner allowing free rotation of the rotatable body in the direction indicated by arrow R.

At one end of the rotatable body is provided a male coupling member 30, with a female coupling member 32 at the opposite end of the rotatable body. By this construction, the distributor may be provided in multiple sections, which matingly engage one another in a manner more fully described hereinafter, as part of a multi-unit screed assembly.

Attached to horizontal frame member 26, by means of the nut and bolt fastener assemblies 34 and 36, are respective generally vertical braces 38 and 40. Braces 38 and 40 are provided with suitable respective openings 42 and 44, and 46 and 48, to facilitate attachment of the distributor to an associated screed.

The nut and bolt fastener assembly 36 is reposed in a generally vertical slot 50 in horizontal frame member 26, to accommodate vertical adjustment of the rotatable body relative to the screed, as may be necessary or desirable in a given application to realize optimum efficiency in the distribution and leveling of wet, freshly poured concrete with which the distributor is contacted.

In like manner, horizontal frame member 28 is connected by nut and bolt fastener assemblies 52 and 54 to generally vertical support braces 56 and 58, the nut and bolt fastener assembly 54 being reposed in a vertical adjustment slot 60 of similar type to slot 50 in frame member 26. Brace 56 features openings 62 and 64, and support brace 58 features openings 66 and 68, to accommodate attachment of the distributor to a screed apparatus.

Figure 8:
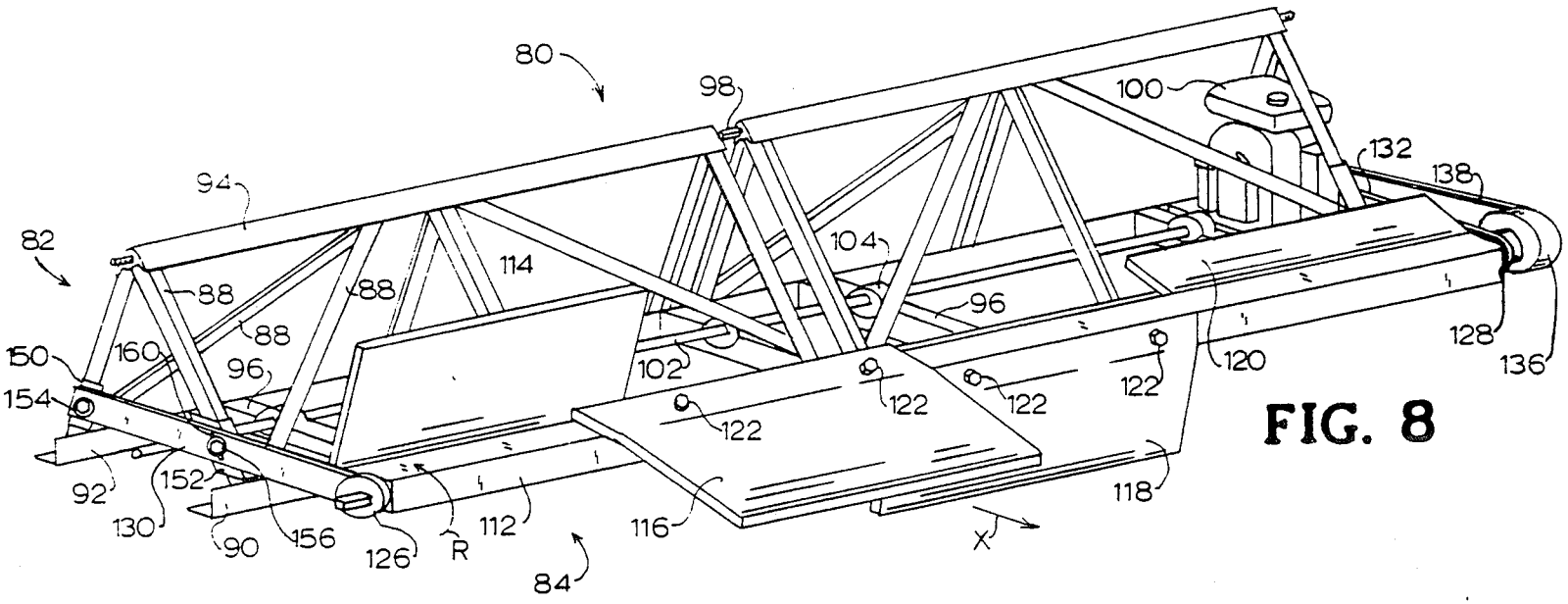
FIG. 8 is a perspective view of a screed assembly according to one embodiment of the present invention.

Referring now to FIG. 8, there is shown a perspective view of a screed assembly 80 according to the present invention. The screed assembly comprises a screed 82, and a distributor 84 of the type previously described.

The screed 82 includes an open structural frame 86 which comprises various braces 88 joining the first screed blade 90 and second screed blade 92 to a longitudinally extending camber top member 94 as shown, whereby the frame has a triangular shape in cross-section.

The various support braces 88 may be joined at the respective camber top member 94 and first screed blade 90 and second screed blade 92 by any suitable means, e.g., mechanical fasteners such as nut-and-bolt assemblies, welding, etc. The open frame may be constructed with any suitable arrangement of such support braces 88, as assembled and oriented in an appropriate manner to rigidify the frame and impart thereto sufficient structural integrity for the intended concrete screeding application.

The open frame also comprises a plurality of longitudinally spaced-apart, tranversely extending frame supports 96, which are joined to the respective front and rear screed blade 90 and 92, thereby forming the base of the screed apparatus.

In order to compensate for the tendency of the frame to bend and deflect the screeding surfaces of the respective front and rear screed blades, the camber top member 94 is provided in two adjacent sections as discrete structural elements, each of which may for example be formed by extrusion of aluminum or other suitable material. Each camber top member section is provided with threaded passages in its respective ends receiving complementarily threaded rods. These threaded rods at the junction at the camber top member sections are turn coupled by a turnbuckle nut 98 to form a turnbuckle assembly. The turnbuckle assembly thus permits adjustment of the relative attitudes of the adjacent camber top member sections, by appropriate loosening or tightening of the turnbuckle nut, whereby the tendency for frame bending and deflection of the screeding surfaces may be compensated for.

The power supply means for the screed embodiment shown in FIG. 8 comprises gasoline engine 100 mounted on the frame on frame supports which are in turn bolted to the respective front and rear screed blades.

Mounted on the frame supports 96 is a longitudinally extending semi-flexible vibratable shaft 102, which may be disposed in bearings 104, as shown. Engine 100 drives the semi-flexible vibrating shaft 102 through a belt operatively joined to a drive shaft of the engine, and attached to a pulley mounted on the vibrating shaft (not shown for clarity).

The vibrating shaft 102 thus passes through a series of bearings 104 housed in bearing supports. The overall vibrating shaft arrangement preferably is of the "loose bearing" form as previously described in applicant's U.S. Pat. No. 4,030,873. Nonetheless, the use of eccentric weights on shaft 102, other vibrators, or the like, may be employed instead of such loose bearing arrangement. For example, the screed may comprise means for imparting vibration to the screed blades which utilize so-called "air vibrators" or other pneumatically driven vibration-imparting means.

The distributor 84 is similar in construction to that shown in and described with reference to FIGS. 1–7 herein. The distributor comprises an axially extending rotatable body 112 bearing circumferentially and axially staggered plate or blade elements 114, 116, 118, and 120. These plate elements are attached to the rotatable body 112 by means of bolt fasteners 122, to facilitate ready removal of individual plate elements, in the event that same are bent or damaged, without requiring removal of the other blades in the array.

The rotatable body 112 features a male coupling 126 at one end thereof, and a female coupling 128 at the other end thereof. The respective ends of the rotatable body are mounted for rotation on horizontal frame members 130 and 132, with the female coupling 128 being joined in driven relationship to the gear box 136. The gear box 136 is in turn coupled with and driven by engine 100 by means of a drive belt 138, whereby the rotatable body 112 is rotated in the direction indicated by arrow R.

Horizontal frame member 130 is secured to frame 86 by means of the generally vertical support braces 150 and 152, together with associated nut and bolt fastener assemblies 154 and 156, the latter fastener assembly being reposed in vertical adjustment slot 160.

The opposite horizontal frame member 132 is similarly attached to frame 86 by generally vertical support brackets and nut and bolt fasteners.

The plate elements 114, 116, 118, and 120 mounted on rotatable body 112 are of "swept back" configuration as previously described in connection with the embodiment of FIGS. 1–7, the plate elements in side profile comprising first and second linear segments lying in respective planes which define an included angle $\alpha$ therebetween, as shown in FIGS. 2 and 7.

As indicated, when the plate elements are mounted tangentially as in the embodiments previously described, such swept back configuration is desirable to optimize distribution and leveling efficiency of the distributor in operation. If such swept back configuration is not provided, the distributor does not have as much capacity as when the plate elements have such configuration. "Capacity" in this respect refers to the ability of the distributor to push and effectively distribute and level a specified height of plastic concrete, i.e., concrete which has been freshly poured, and not appreciably hardened. Thus, for example, the provision of plate elements having a linear side edge profile may result in the capacity of the distributor in a given application being only about 4 inches height of concrete, whereas angular flaring of the outer segment of the plate element, at an angle (relative to the plane of the inner segment) of about 10° to about 15° may increase the capacity of the distributor to approximately 5 inches of plastic concrete.

The angular orientation of the outer segment of the plate element to the inner (tangential) segment, as measured by the aforementioned included angle, may broadly range from about 5° to about 30°, with about 10° to about 30° generally being preferred, and from about 15° to about 25° being most preferred.

For a distributor 84 having the specific dimensions previously described by way of illustration in connection with FIGS. 1–7 herein, the screed on which such distributor is mounted may have the following characteristics. The screed blades 90 and 92 may each have respective vertical and horizontal segments of 3 inches width, joined to one another in the right angle formation shown, and extending the full axial extent of the frame 86.

The frame may have an axial, or longitudinal, dimension of about 10 feet, with the height of the triangular frame, as measured vertically from the base to the camber top member 94 being 21 inches. In such system, the lateral, spacing between the first and second screed blades 90 and 92 is about 20 inches. The gear box 136 may suitably be constructed to rotate the rotatable body 112 at a speed of about 120 rpms in the direction indicated by arrow R.

Thus, the direction of movement of the distributor plate elements is toward the screed in the upper quadrants of distributor rotation ("quadrants" here referring to the 90° arc length sectors, each bounded by a vertical and a horizontal line, about the axis of rotation of the distributor as viewed in end view, such as in FIG. 11, described more fully hereinafter) and away from the screed in the lower quadrants of distributor rotation. The engine in this illustrative screed assembly may suitably be a gasoline powered type. The screed is advanced in the direction indicated by arrow X concurrently with rotation of the rotatable body 112 in the direction indicated by arrow R. As a result, there is achieved a highly efficient distribution and leveling of freshly poured concrete by the plate elements 114, 116, 18, and 120, following by screeding of the thus-leveled concrete by the successive active screeding surfaces of screed blades 90 and 92.

Figure 9:
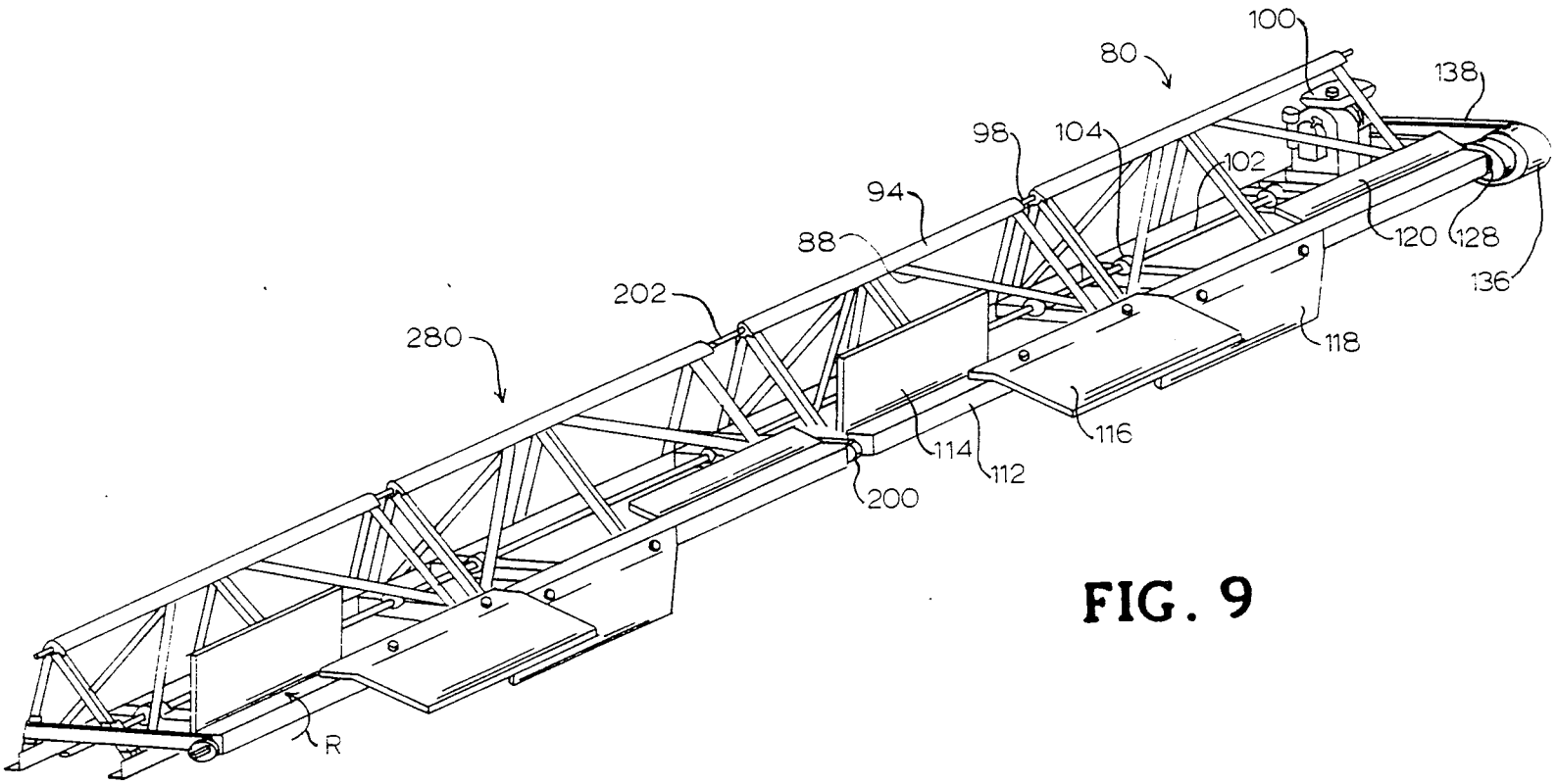
FIG. 9 is a perspective view of a multi-unit screed assembly according to one embodiment of the present invention.

FIG. 9 is a perspective view of a multi-unit screed assembly comprising a first screed assembly sub-unit 80, which is constructed similarly constructed to the screed assembly shown in FIG. 8, with corresponding reference numerals being used in both drawings.

The multi-unit screed assembly thus comprises a first sub-unit 80, and a second screed assembly sub-unit 280, which is constructed correspondingly to sub-unit 80.

The sub-units 80 and 280 are joined to one another by a turnbuckle assembly 202 which is similar in construction to the turnbuckle assemblies utilized to join constituent sections of each sub-unit, as previously described in FIG. 8. The screed blades of the respective sub-units are correspondingly joined to one another by bolting or other detachable attachment means, whereby any number of sub-units can be sequentially joined to form a multi-unit screed assembly of desired length.

In operation, the screed assemblies shown in FIGS. 8 and 9 are moved forwardly in the direction indicated by the arrows labeled X in the respective drawings, with the distributor being rotated in the direction indicated by arrow R in each drawing. Such movement may be effected manually, such as by ropes, cables, wires, or the like, attached at respective ends of the screed apparatus, and manually drawn forwardly, as for example is shown in FIG. 1 of U.S. Pat. No. 4,030,873, or in any other suitable manner accommodating manual drawing of the apparatus in the desired direction. Alternatively, the screed could be reposed on upper edges of a form bounding the area to be screeded, and manually pushed, at its respective ends, forwardly across the area to be screeded.

In most applications, however, it is preferable to utilize an automatic winching system, whereby the screed assembly may be drawn forwardly at controlled rate by suitable mechanical winching means mounted on the screed and joined to wires, cables, ropes, or the like.

An illustrative winching system, in which the gasoline engine or other power source for the screed is connected to hydraulic motors, having spools attached thereto on which cable is taken up to advance the screed in the desired direction is shown in my U.S. Pat. No. 4,722,638 issued Feb. 2, 1988. In this system, the cables are secured fixably at the end of the area to be screeded, and the hydraulic motors rotate the spool to take up the cable, thereby drawing the screed assembly forwardly toward the fixidly secured ends of the connecting cables. Such drawing means are not shown in FIGS. 8 and 9, for clarity.

In FIG. 9, there is shown a bearing 200 connecting the rotatable body of the respective screed assembly sub-units with one another. The details of such bearing coupling arrangement are illustrated in FIG. 10, which shows an exploded perspective view thereof.

Figure 10:
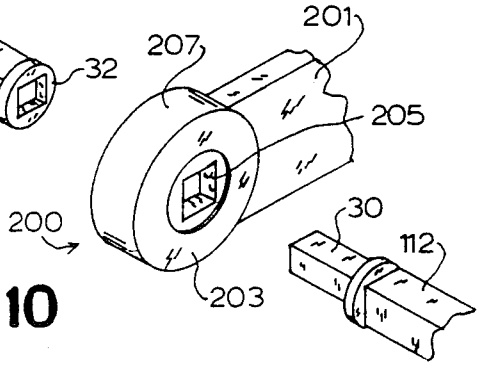
FIG. 10 is a perspective view of the bearing and joint assembly for interconnection of adjacent distributors in the multi-unit assembly of FIG. 9.

As shown in FIG. 10, the bearing support assembly 200 comprises a horizontal frame member 201 joined, e.g., by welding, to a frontal cylindrical sleeve 207 containing a roller bearing having a square-shaped opening 205 therein. An annular-shaped retaining ring 203 is joined, e.g., by welding, at its periphery to sleeve 207, to retain the bearing in place. A similar retaining ring (not shown) is also peripherally joined to sleeve 207 at the face opposite that shown in FIG. 10, so that the two retaining rings and sleeve corporately form an enclosure within which the roller bearing is retained and able to freely rotate.

The rotatable body 112 (the blade elements are omitted for clarity from both of the illustrated rotatable bodies) is provided on its extremity with a male coupling member 30, and the corresponding rotatable body 112' of the adjacent sub-unit of the screed assembly is provided at its corresponding adjacent extremity with a female fitting 32 having a square-shaped opening therein which is complementary to the closely fitting male coupling 30. Dimensionally, the square-shaped opening in the rotatable bearing in the bearing support assembly 200 and the female coupling 32 are slightly larger than the corresponding dimensions of the male coupling 30, to provide a somewhat loose connection between the male and female couplings thereby allowing vibration to be transmitted by the frame and bearing support 200 to the associated areas of rotatable bodies 112 and 112'. Thus, where the screed is of a vibrating type, the vibrations may be transmitted to the frontal rotating body to assist in distributing and leveling the wet concrete. Alternatively, if it is desired to isolate the rotatable body and plate elements from vibration, the horizontal support member joining the distributor to the open frame of the screed may be equipped with damping mechanisms such as shock absorbers or the like whereby such vibration is restricted to the screed per se.

As an illustrative example of the screed assembly of the present invention, wherein the distributor and screed have the specific dimensions described earlier herein, a multi-unit screed assembly comprising two screed assembly units, each 10 feet in length, having an included angle between the planes of the respective plate element segments of 17°, was employed to distribute and screed poured concrete bounded by a 25 feed × 18 feet form. The height of the poured concrete was approximately 5–6 inches, and no effort was made to manually level or distribute the concrete as poured. The distributor rotatable body was rotated at a speed of 120 rpm, and provided a highly efficient distribution, leveling, and screeding of the poured concrete when the screed was drawn forwardly at a rate of 6 feet per minute. This is a very rapid screed advancement rate, and is all the more significant for the fact that it was achieved without any manual distribution or leveling of the poured concrete.

As a further modification, it may be desirable in some instances to provide a protective guard or fender mounted on the open frame of the screed, extending longitudinally of the open frame, and overlying the distributor, to prevent concrete throw-out, particularly when the rotational speed of the distributor is high, as well as to prevent injury to operating personnel during the use of the screed assembly.

Figure 11:
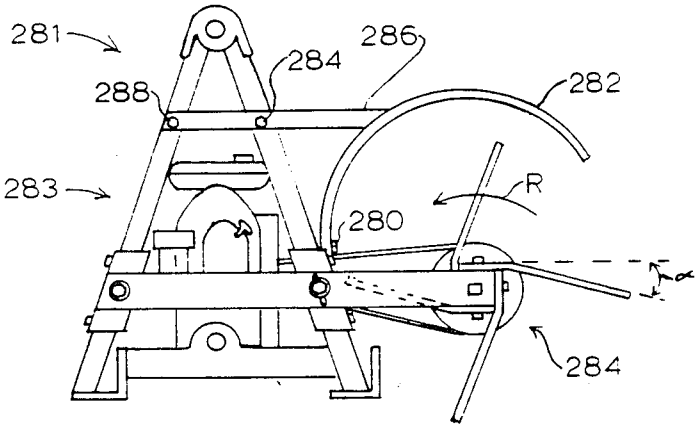
FIG. 11 is an end elevation view of a screed assembly similar to that shown in FIG. 8, but modified by the provision of a guard member overlying the distributor.

FIG. 11 shows an end elevation view of a screed assembly of a type similar to that shown in and described with reference to FIG. 8, but employing such a protective fender 282 bolted to the frame by nut and bolt fastener 280 and welded to a horizontal support member 286 which is fastened to respective braces of the triangular truss with nut and bolt fasteners 284 and 286, respectively.

The screed assembly 281 illustrated in FIG. 11, comprising screed 283 and distributor 284, is otherwise analogous in construction to the screed assembly shown in FIG. 8.

Figure 12:
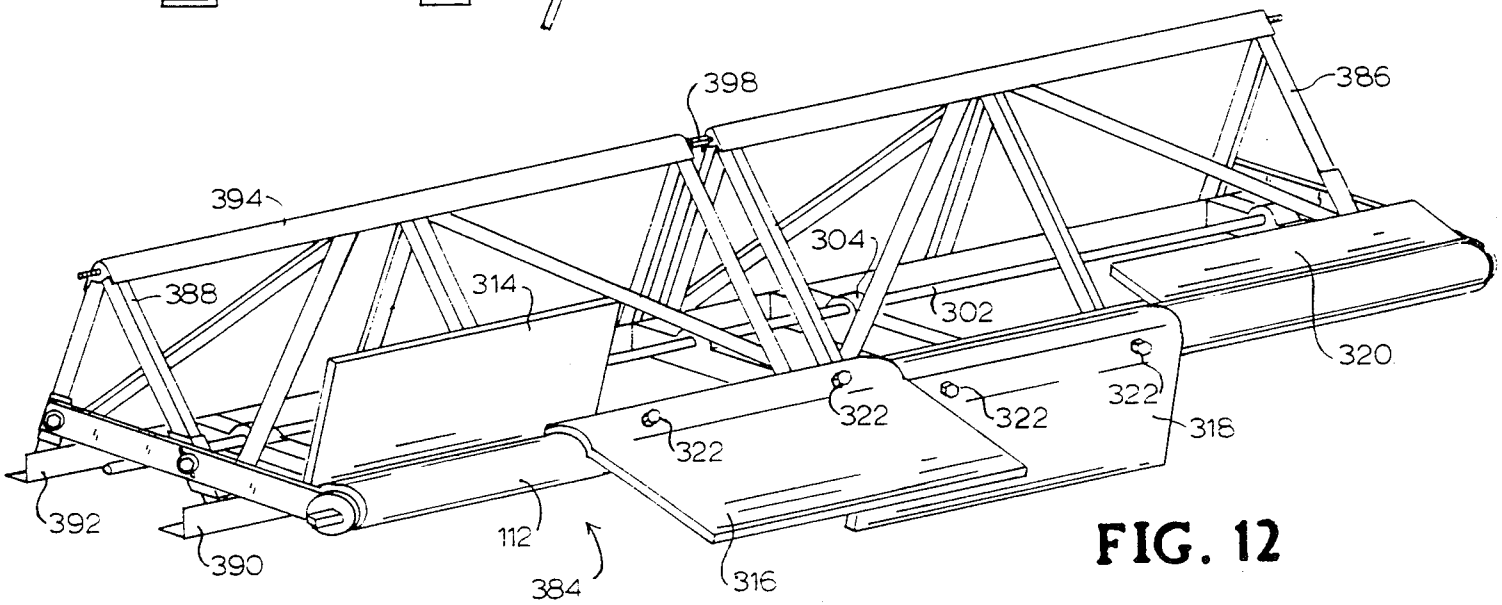
FIG. 12 is a perspective view of a screed assembly according to another embodiment of the present invention.

FIG. 12 shows a screed assembly according to another embodiment of the present invention, wherein the screed comprises an open frame 386 comprising support braces 388, joining a camber top member 394 with respective front and rear screed blades 390 and 392. The screed is provided with a vibrating shaft 302 mounted in loose bearing supports 304 to impart vibration to the screed plates and thereby enhance the efficacy of the screeding operation. The respective camber tops of the adjacent sections making up the screed are joined by a turnbuckle assembly 398, with the screed plates of the adjacent sections being bolted to one another (not shown). The screed unit shown in FIG. 12 does not feature a motor or other drive means, since it is an auxiliary or add-on unit intended to be joined to another screed unit which is similarly 10 constructed, but provided with such motor other drive means. When such units are longitudinally joined to one another, the respective vibratable shafts of the constituent units are suitably joined by a collar or coupling so that the respective shafts are commonly rotatable.

The distributor 384 of this screed assembly comprises a tubular cylindrical rotatable body 112, to which is attached by bolt fasteners 322 a series of circumferentially and axially staggered plate elements 314, 316, 318, and 320.

In contrast to the plate elements utilized in the FIG. 8 screed assembly, the plate elements of the FIG. 12 distributor feature a curvate inner segment facilitating flush mounting to the cylindrical surface of the rotatable body 112, and a planar outer segment which is oriented at the proper angular orientation for efficient distributing and leveling of plastic concrete.

As indicated hereinabove, the distributor may comprise any suitable rotatable body and plate elements of widely varying configuration, it being necessary only that sufficient surface area and rotational speed are employed to bring the plate elements into adequate contact with the wet concrete to distribute and level same, prior to contacting of the wet concrete with the active screeding surface(s) the screed blade element(s).

Further, while the invention has been shown in embodiments herein as having the distributor rotatable body coupled by suitable belt means to a gasoline engine or other engine means, it may also be advantageous have the rotatable body of the distributor driven by a hydraulic motor which is supplied with fluid by a pump which is turn coupled with the engine mounted on the screed frame. Alternatively, any other motive power supply means could be utilized to rotate the distributor so that the plate elements in the upper quadrants of their rotation move toward the screed and in the lower quadrants of rotation move away from the screed, i.e., counterclockwise in the end view shown in FIG. 11.

The distributor of the present invention thus may be detachably mounted on a screed frame, by mechanical fasteners or in other suitable manner, or alternatively, the distributor may be welded or otherwise permanently attached to the frame.

While the invention has been shown and described with reference to embodiments wherein a single power supply system, such as a gasoline engine, is utilized to effect rotation of the distributor, furnish power to a vibration-generating structure, and provide power to an automatic winching system, it will be appreciated that separate power supply means may be utilized for each of such functions, as may be carried out by a given screed device. For example, a separate gasoline engine may be employed to rotate the distributor, while a separate pneumatic system is employed to power an air vibrator; concurrently, a third power supply could be employed to power hydraulic motors for an automatic winching system, as previously described. Further, it is within the purview of the present invention, when multi-unit screed assemblies are employed, to independently drive the distributor section of each constituent sub-unit by a separate power supply mounted on the sub-unit frame. Thus, it will be appreciated that there are numerous variations and modifications possible, depending on the specific structure and operation of the screed assembly utilizing the distributor of the present invention.

Screed assemblies utilizing the distributor of the present invention have been demonstrated to provide highly efficient distribution and leveling of freshly poured concrete for subsequent screeding by the screed surfaces disposed rearwardly of the distributor. Although in the embodiments herein illustrated, the screeds are of a triangular frame type featuring leading and trailing screed blades, it will be appreciated that it is within the broad scope of the present invention to utilize screeds having greater or lesser numbers of screed blades or other active screeding surfaces.

Thus, while the invention has been described with reference to specific details, features, and embodiments, it will be appreciated that numerous variations, modifications, and embodiments are possible, and accordingly all apparent variations, modifications and embodiments are to regarded as being within the spirit and scope of the invention.

What is claimed is:

1. A distributor assembly frontally mountable on a screed, and comprising:

(a) a distributor including:

(i) an axially extending rotatable body; and (ii) an array of circumferentially and axially staggered plate elements joined to said rotatable body; and (b) means for detachably securing said distributor to said screed frontally and cantileveredly thereof, said means comprising elongate horizontal frame members extending forwardly to frontal end portions on which ends of said rotatable body are respectively mounted to allow free rotation of said rotatable body thereon, said horizontal frame members being adjustably mechanically fastened at rear portions thereof to vertical support braces to permit vertical adjustment of the position of the rotatable body relative to the screed, and mechanical fastener means for detachably attaching said vertical support braces to the screed.

2. A distributor according to claim 1, wherein said rotatable body has a rectangular cross-section in a plane perpendicular to the axis of rotation of said rotatable body.

3. A distributor according to claim 1, wherein said rotatable body has a square cross-section in a plane perpendicular to the axis of rotation of said rotatable body.

4. A distributor according to claim 3, wherein said plate elements comprise inner plate segments joined to said rotatable body in face-to-face mating relationship, and outer plate segments extending outwardly from said rotatable body.

5. A distributor according to claim 4, wherein each axially succeeding plate element in said array is joined to a next successive face of said rotatable body, about the circumference thereof.

6. A distributor frontally mountable on a screed and comprising:

(a) an axially extending rotatable body having a square cross-section in a plane perpendicular to its axis of rotation;

(b) an array of circumferentially and axially staggered plate elements joined to said rotatable body, each axially succeeding plate element in said array being joined to a next successive face of said rotatable body, about the circumference thereof, wherein each plate element comprises a first inner segment joined in face-to-face contacting relationship to said rotatable body, and a second segment extending outwardly and angularly with respect to the first segment, with the first and second segments being reposed in separate planes defining therebetween an included angle of from about 5° to about 30°; and (c) means for joining said distributor to a said screed.

7. A distributor according to claim 6, wherein said second segments of said plate elements are swept back in orientation, away from the direction of rotation of said rotatable body.

8. A distributor according to claim 6, wherein said included angle is from about 10° to about 25°.

9. A distributor according to claim 6, wherein said included angle is from about 15° to about 20°.

10. A screed assembly, comprising:

a screed; and a distributor cantileveredly mounted on said screed, said screed comprising:

(i) an axially extending rotatable body;

(ii) an array of circumferentially and axially staggered plate elements joined to said rotatable body; and (iii) means for detachably securing said distributor to said screed frontally and cantileveredly thereof, said means comprising elongate horizontal frame members extending forwardly to frontal end portions on which ends of said rotatable body are respectively mounted to allow free rotation of said rotatable body thereon, said horizontal frame members being adjustably mechanically fastened at rear portions thereof to vertical support braces to permit vertical adjustment of the position of the rotatable body relative to the screed, and mechanical fastening means for detachably attaching said vertical support braces to the screed.

11. A screed assembly comprising:

(a) a screed comprising an elongate open frame of triangular cross-section, with screed blades mounted at lower apices thereof; and (b) a distributor frontally mounted on said screed, and comprising:

(i) an axially extending rotatable body;

(ii) an array of circumferentially and axially staggered plate elements joined to said rotatable body; and (iii) means for joining said distributor to said screed.

12. A screed assembly according to claim 10, further comprising an engine mounted on said screed and drivingly connected to a rotatable shaft extending longitudinally of the screed and mounted in loose bearings.

13. A screed assembly according to claim 10, further comprising a guard member mounted on said screed, and overlying said rotatable body and array of plate elements joined thereto.

14. A screed assembly according to claim 1, wherein said frame members are vertically adjustable to vary the relative height of the rotatable body relative to the screed.

15. A screed assembly according to claim 13, wherein said engine is drivingly connected to said rotatable body.

16. A screed assembly according to claim 10, comprising means associated with said screed for driving said rotatable body at selected rotational speed.

17. A screed assembly according to claim 16, wherein said driving means are constructed and arranged to rotate the rotatable body such that the direction of movement of said plate elements during rotation of the rotatable body is toward the screed in the upper quadrants of travel and away from the screed in the lower quadrants of travel.

18. A method of forming a screeded concrete body in a selected area, comprising:

(a) providing a screed assembly according to claim 16;

(b) pouring wet concrete on said area; and (c) translating said screed assembly across the poured wet concrete, with the screed assembly oriented so that the wet concrete is first contacted by the plate elements of said distributor and subsequently by active screeding surface(s) of said screed and with the direction of rotation of said rotatable body being such that the direction of travel of the plate elements in the upper quadrants of rotation is toward the screed, and in the lower quadrants of rotation is away from the screed.

19. A method according to claim 18, further comprising imparting vibration to the active screeding surface(s).

20. A screed assembly according to claim 10, wherein the screed comprises active screeding surface(s), further comprising means for imparting vibration to the active screeding surface(s).

* * * * *